US006694864B2

(12) United States Patent
Kato et al.

(10) Patent No.: US 6,694,864 B2
(45) Date of Patent: Feb. 24, 2004

(54) SWASH PLATE TYPE COMPRESSOR

(75) Inventors: Takayuki Kato, Kariya (JP); Hayato Ikeda, Kariya (JP); Seiji Katayama, Kariya (JP); Masaaki Taga, Kariya (JP); Noriyuki Shintoku, Kariya (JP); Toru Takeichi, Kariya (JP); Motonobu Kawakami, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 147 days.

(21) Appl. No.: 10/091,961

(22) Filed: Mar. 6, 2002

(65) Prior Publication Data

US 2002/0174764 A1 Nov. 28, 2002

Related U.S. Application Data

(63) Continuation-in-part of application No. 09/308,946, filed on May 26, 1999, now abandoned.

(51) Int. Cl.[7] ..... F01B 31/10
(52) U.S. Cl. ..... 92/71; 228/115
(58) Field of Search ..... 92/71, 12.2; 228/115; 29/888.02

(56) References Cited

U.S. PATENT DOCUMENTS

| | | | | |
|---|---|---|---|---|
| 1,768,528 A | * | 6/1930 | Short | 29/898.1 |
| 4,512,175 A | | 4/1985 | Kaku et al. | 73/360 |
| 5,056,417 A | | 10/1991 | Kato et al. | 92/71 |
| 5,655,432 A | | 8/1997 | Wilkosz et al. | 92/71 |
| 5,941,160 A | * | 8/1999 | Kato et al. | 92/71 |
| 5,996,467 A | * | 12/1999 | Churgay et al. | 92/71 |
| 6,129,996 A | | 10/2000 | Cordy | 428/646 |
| 6,192,784 B1 | | 2/2001 | Kato et al. | 92/71 |
| 6,217,295 B1 | | 4/2001 | Kato et al. | 417/269 |

FOREIGN PATENT DOCUMENTS

| | | | |
|---|---|---|---|
| EP | 0 776 986 A1 | 6/1997 | C23C/4/08 |
| JP | 6-022080 | 2/1985 | F04B/25/04 |

* cited by examiner

*Primary Examiner*—Edward K. Look
*Assistant Examiner*—Igor Kershteyn
(74) *Attorney, Agent, or Firm*—Morgan & Finnegan, LLP

(57) ABSTRACT

A swash plate (3, 18) included in a swash plate type compressor for compressing a refrigerant is made of an aluminum alloy as a base material. Sliding contact surfaces (3*a*, 18*a*) of the swash plate (3, 18) in sliding contact with shoes (7, 19) linking the swash plate (3, 18) to pistons (6, 17) are coated with a film of a solid lubricant containing at least one lubricating material selected from molybdenum disulfide, tungsten disulfide and graphite by a transfer method. Therefore, the performance of the film and the productivity thereof are improved.

4 Claims, 7 Drawing Sheets

SWASH PLATE TYPE COMPRESSOR

TECHNICAL FIELD

This application is a Continuation-in-Part of U.S. application Ser. No. 09/308,946, entitled "Swash Plate Type Compressor", filed May 26, 1999 now abandoned. The present invention relates to a swash plate type compressor and, more particularly, to a highly reliable swash plate type compressor provided with a swash plate finished by surface treatment and capable of functioning with improved performance.

BACKGROUND ART

A double-headed swash plate type compressor applied to an automobile air conditioning system, for example, has a drive shaft, a pair of cylinder blocks supporting the drive shaft for rotation, and a swash plate fixedly supported on the drive shaft for rotation together with the drive shaft in a swash plate chamber formed in a region including the boundary between the pair of cylinder blocks. A plurality of cylinder bores are formed so as to extend in both the cylinder blocks and are arranged around the drive shaft. Double-headed pistons are fitted for axial movement in the cylinder bores, respectively. Each piston is operatively engaged with the swash plate via shoe elements. The rotary motion of the swash plate is converted into the linear motion of the pistons for the suction, compression and discharge of a refrigerant gas.

A single-headed swash plate type compressor has a cylinder block, and a housing closing an inner end of the cylinder block and having a swash plate chamber or a crank chamber. A swash plate is mounted on a drive shaft in the swash plate chamber and is engaged with pistons by shoes. Further, in a variable-displacement swash plate type compressor, a swash plate is engaged with single-headed pistons fitted in a plurality of cylinder bores by shoes, and is mounted on a drive shaft so as to wobble on a supporting point. The inclination of the swash plate is changed according to pressure in the crank chamber so that gas pressures acting on the opposite ends of the single-headed piston balance each other. Consequently, the stroke of the single-headed piston is adjusted to control the displacement of the compressor.

The demand for weight reduction in the aforementioned swash plate type compressors has progressively increased and the swash plate type compressors for automobile air conditioning or climate control systems, including the swash plates, the pistons, and the cylinder blocks are now made of aluminum alloys. Therefore, abrasion-resistant and seizing-preventive measures have been examined to protect surfaces exposed to severe, high-speed abrasive actions for a long time, such as the surfaces of the swash plate in sliding contact with the shoes, and the sliding contact surface of the piston in sliding contact with the surface of the bore. Such measures include the formation of a fluorocarbon resin film on the sliding contact surface of the piston and the formation of a film of a solid lubricant on the sliding contact surface of the swash plate.

The double-headed piston, however, is provided with a recess extending across the periphery of the swash plate, and interfering surfaces formed in the recess to prevent the piston from rotation about its own axis come into impulsive contact with the outer circumference of the swash plate to prevent the piston from rotation by a rotation moment acting on the piston. The single-headed piston is provided with a rotation-preventive interfering surface in its base end part, and the interfering surface comes into impulsive contact with the inner surface of the housing to restrain the piston from rotation. Accordingly, it is possible, under a substantially nonlubricated state which occurs at the start of the compressor, that seizing occurs between the interfering surface of the piston and the outer circumference of the swash plate, and attempts have been made to form a lubricating film over the interfering surface of the piston and the outer circumference of the swash plate. However, in formtion of a lubricating film, when, for example, a spray coating process for coating the swash plate with a lubricating film is used, the yield of formation of the coating material film is usually very low. Furthermore, since the strength of an adhesive bond of the lubricating film and the sliding contact surface is low, such a protective measure using the lubricating film is not satisfactory in reliability as well as in its seizing-preventive effect.

DISCLOSURE OF THE INVENTION

It is an object of the present invention to provide an improved swash plate type compressor capable of providing improved functional reliability attained by employing an improved swash plate coated with an excellent film and capable of being manufactured with a high productivity.

Another object of the present invention is to provide a long-life swash plate type compressor capable of properly functioning, over an extended period of use, when applied to an automobile air conditioning system and driven by the engine of a vehicle to compress a refrigerant.

In accordance with the present invention, there is provided a swash plate type compressor which comprises: a cylinder block provided with a plurality of cylinder bores; pistons fitted in the cylinder bores; a drive shaft supported for rotation about its axis of rotation; and a swash plate supported for rotation together with the drive shaft, having at least sliding contact surfaces to be in sliding contact with shoes and operatively engaged with the pistons via the shoes; wherein the sliding contact surfaces of the swash plate in sliding contact with the shoes are coated with a film of at least one solid lubricant selected from molybdenum disulfide, tungsten disulfide and graphite by a transfer method.

The film of the solid lubricant formed on the sliding contact surface of the swash plate in sliding contact with the shoes exercises excellent lubricating performance, and the transfer method of forming the film of the solid lubricant is very advantageous from the viewpoint of economy and productivity in the yield of the coating material and the control of the thickness of the film.

If the swash plate has an outer circumference to be in impulsive contact with interfering surfaces formed respectively in the pistons, it is preferable that a film of the solid lubricant is formed on the outer circumference by a transfer method. Thus, the contact surface to be in impulsive contact with the piston, in addition to the sliding contact surface in sliding contact with the shoes, is able to secure a further satisfactory seizing-resistant property.

If the sliding contact surfaces of the swash plate on which the film is formed, i.e., base surfaces for the film, are subjected to a surface roughening process, a coating material for forming the film is forced to dig into minute irregularities formed by the plastic deformation of the base surfaces to provide an anchoring effect which enhances the strength of connection of the film to the base surfaces. If the sliding contact surface and the outer circumference of the swash plate are coated for surface preparation with a plated film of a material containing tin as a principal component, the plated film prevents the aluminum base of the swash plate from being exposed even if part of the plated film falls off, and serves as a lubricating layer. Therefore, the swash plate has excellent durability.

Preferably, the film formed on the sliding contact surface of the swash plate is finished by grinding to adjust the thickness of the film and finish the surface of the film in a high surface accuracy (flatness).

BRIEF DESCRIPTION OF THE DRAWINGS

The above and other objects, features and advantages will become apparent from the ensuing description of the preferred embodiments taken in conjunction with the accompanying drawings, wherein.

BEST MODE OF CARRYING OUT THE INVENTION

Figure 1:
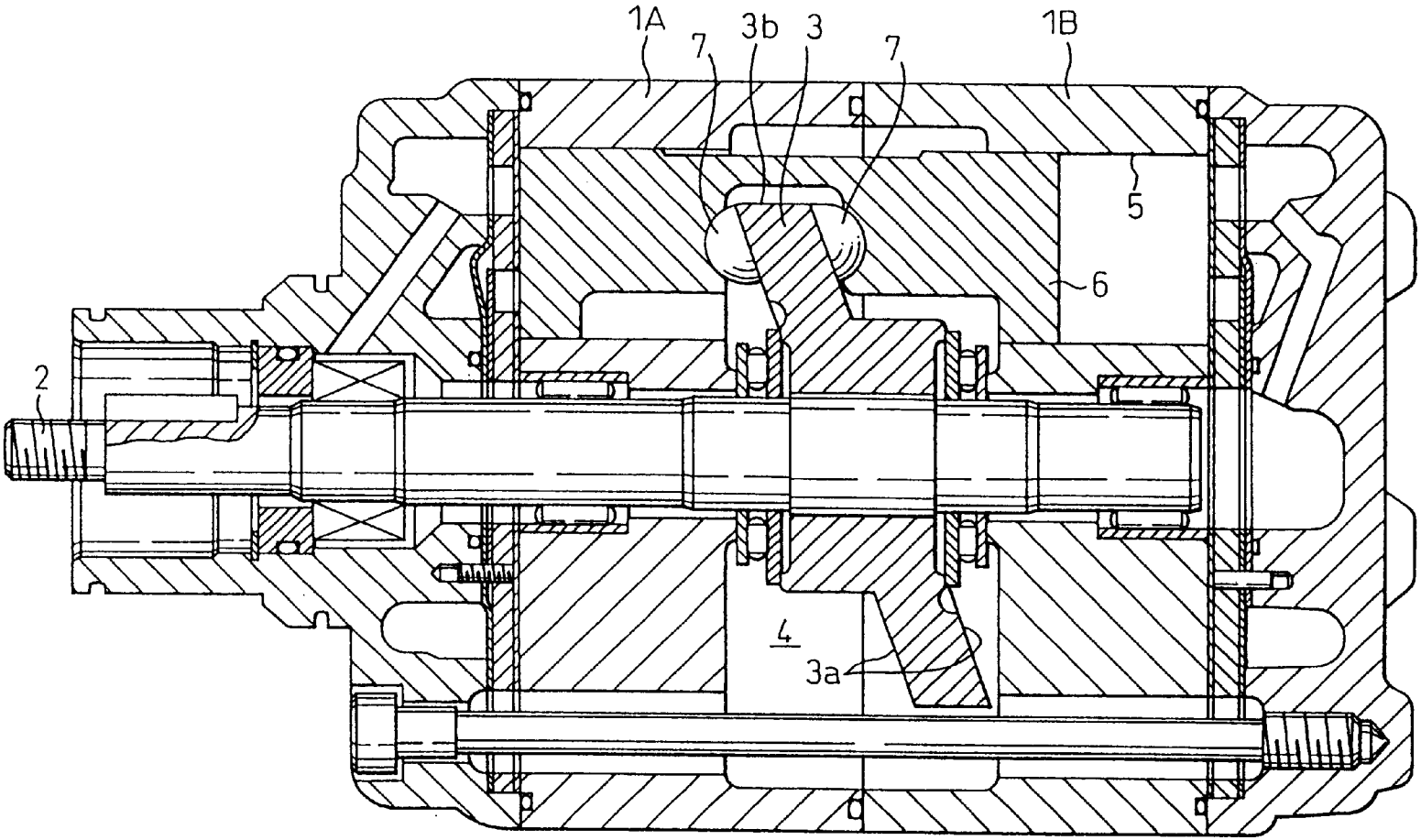
FIG. 1 is a longitudinal sectional view of a double-headed swash plate type compressor in a preferred embodiment according to the present invention.
Figure 2A:
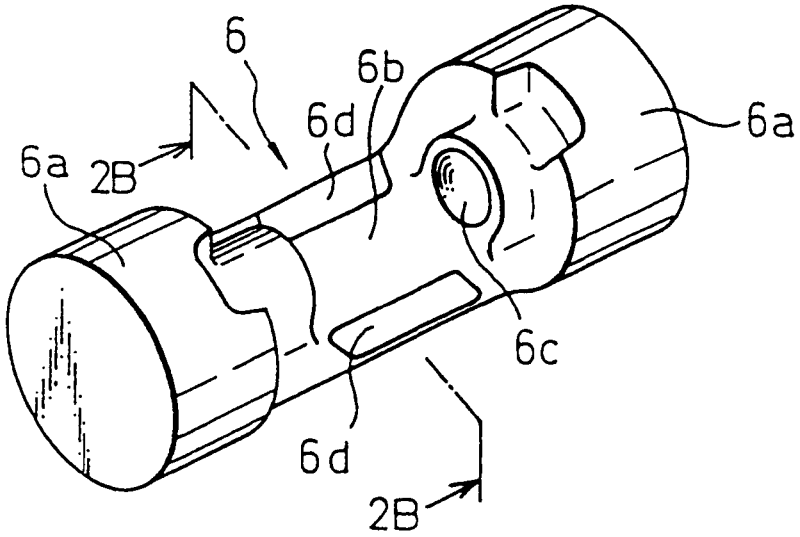
FIG. 2A is a perspective view of a double-headed piston employed in the compressor of FIG. 1.
Figure 2B:
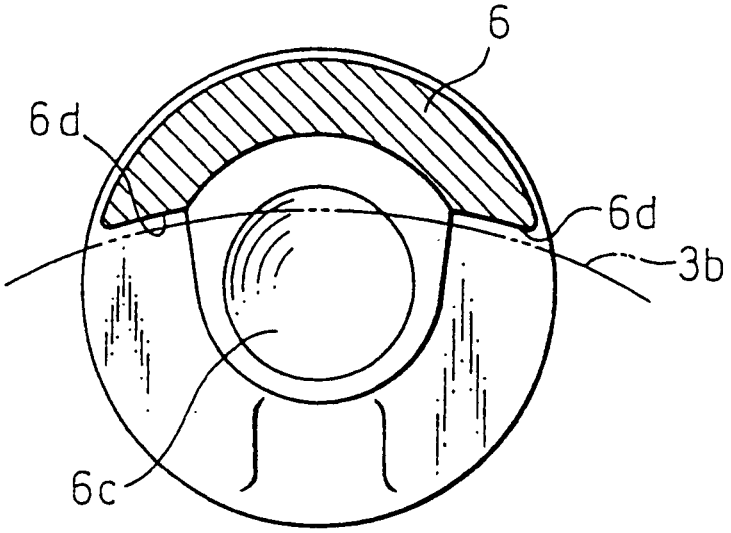
FIG. 2B is a longitudinal sectional view taken on line 2B—2B in FIG. 2A.

Referring to FIGS. 1, 2A and 2B, a double-headed swash plate type compressor has a front cylinder block 1A and a back cylinder block 1B, and a drive shaft 2 is supported for rotation about an axis of rotation on the cylinder blocks 1A and 1B. A swash plate chamber 4 is formed in a region around the joint of the cylinder blocks 1A and 1B in the cylinder blocks 1A and 1B. A swash plate 3 is contained in the swash plate chamber 4 and is combined with the drive shaft 2 for rotation together with the drive shaft 2. Bores of a predetermined diameter are formed in the cylinder blocks 1A and 1B, and the cylinder blocks 1A and 1B are joined together with the respective axes of the corresponding bores aligned with each other so as to form a plurality of axial cylinder bores (hereinafter referred to simply as "bores") 5 arranged around the drive shaft 2. Opposite end parts of double-headed pistons 6 are fitted in the bores 5, respectively, for axial sliding movement. Each piston 6 is linked to the sliding contact surfaces 3*a* of the swash plate 3 by shoes 7. A rotary motion of the swash plate 3 is converted into a linear motion of the piston 6 for the suction, compression and discharge of a refrigerant gas.

In this embodiment, the shoes 7 are made of an iron based material and the cylinder blocks 1*a* and 1B, the swash plate 3 and the double-headed pistons 6 are made of an aluminum alloy such as a hypereutectic aluminum-silicon alloy.

As best shown in FIGS. 2A and 2B, the double-headed piston 6 has cylindrical sliding contact surfaces 6*a* of a predetermined length formed in the opposite end parts thereof and capable of being slidably fitted in the bores 5, and a recess 6*b* formed in a middle part thereof between the opposite end parts provided with the sliding contact surfaces 6*a* so as to extend across the outer circumference of the swash plate 3. Semispherical seats 6*c* in which the shoes 7 are seated, respectively, are formed axially opposite to each other in the recess 6*b*. Interfering surfaces 6*d* for restraining the piston 6 from rotation are formed axis-symmetrically in the middle part. The interfering surfaces 6*d* come into impulsive contact with the outer circumference 3*b* of the swash plate 3 to inhibit the rotation of the piston 6 about its axis by a rotation moment exerted by the shoes 7 on the piston 6.

Figure 3:
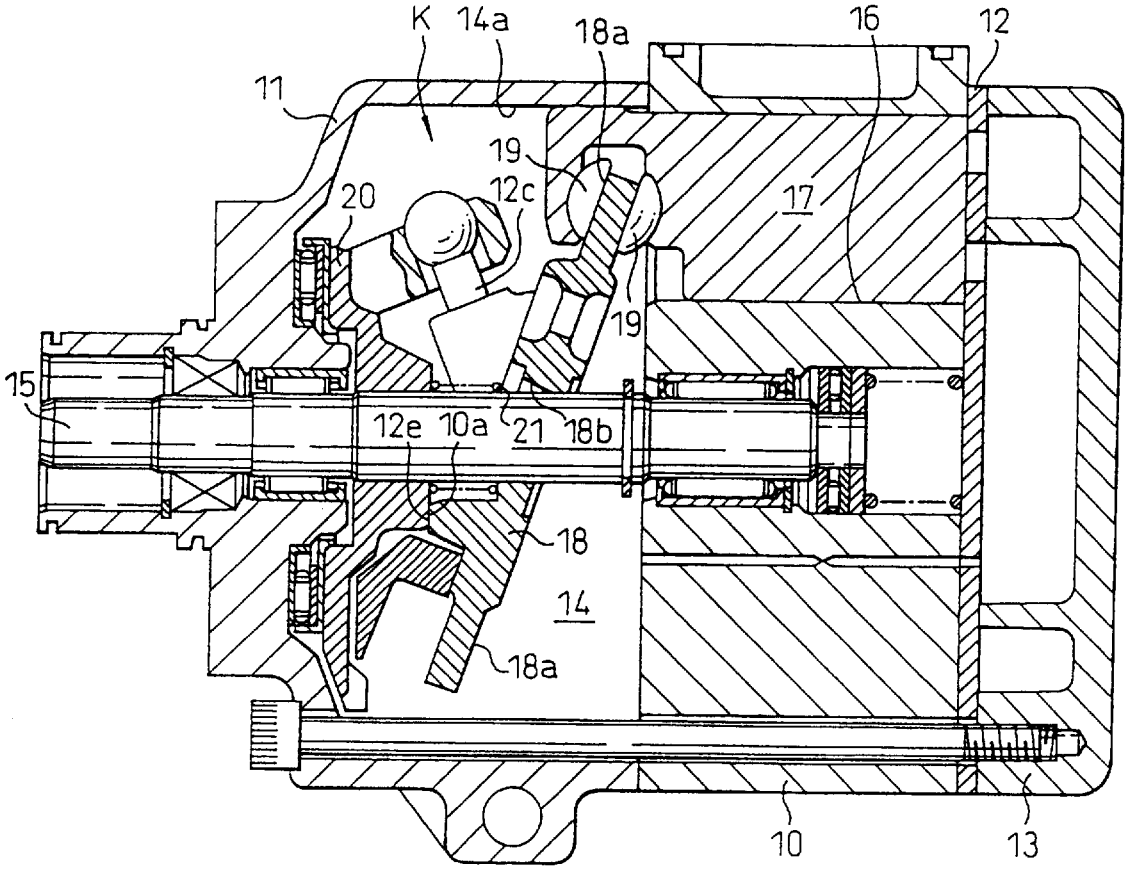
FIG. 3 is a longitudinal sectional view of a single-headed swash plate type compressor in another embodiment according to the present invention.
Figure 4A:
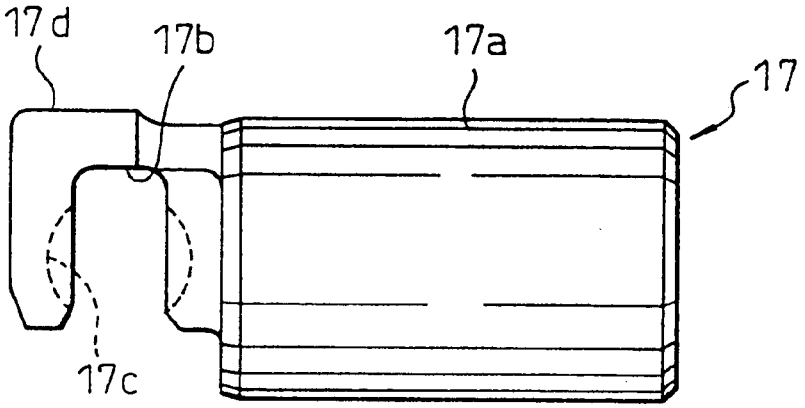
FIG. 4A is a front view of a single-headed piston employed in the compressor of FIG. 3.
Figure 4B:
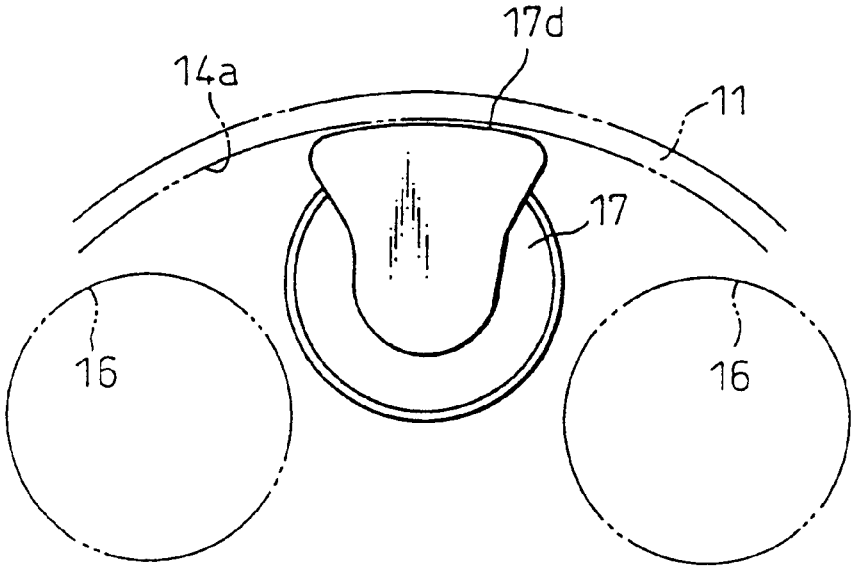
FIG. 4B is a rear end view showing a rotation preventing interfering surface formed in the single-headed piston.

Referring to FIGS. 3, 4A and 4B, a variable-displacement swash plate type compressor in another embodiment according to the present invention has a cylinder block 10 having opposite end surfaces, a front housing 11 connected to the cylinder block 10 so as to cover the front end of the cylinder block 10, a valve plate 12 placed on the rear end surface of the cylinder block 10, and a rear housing 13 connected to the cylinder block 10 so as to cover the rear end of the cylinder block 10. The cylinder block 10, the front housing 11 and the rear housing 13 are firmly fastened together with through bolts so that the connecting portions thereof are tightly sealed. In the compressor, the cylinder block 10 and the front housing 11 define a crank chamber 14, and a drive shaft 15 is extended axially in the crank chamber 14 and is supported for rotation in a pair of radial bearings held respectively on the cylinder block 10 and the front housing 11.

A plurality of cylinder bores (hereinafter referred to simply as "bores") 16 are formed around the drive shaft 15 in the cylinder block 10, and single-headed pistons 17 are fitted for reciprocation in the bores 16, respectively.

In the crank chamber, a rotor 20 is fixedly mounted on the drive shaft 15 for rotation together with the drive shaft 15. An axial load exerted on the rotor 20 is sustained, through a thrust bearing, by the front housing 11. A swash plate 18 is mounted on the drive shaft 15 at a position behind the rotor 20. The swash plate 18 is always biased backward by the resilience of a compression spring interposed between the swash plate 18 and the rotor 20.

The swash plate 18 has a shape generally resembling a plate and is provided with flat sliding contact surfaces 18*a* formed on the opposite sides of a peripheral part thereof. Semispherical shoes 19 are put in contact with the sliding contact surfaces 18*a*, respectively. The shoes 19 are in sliding contact with semispherical seats 17*c* formed in the piston 17. A hinge mechanism K is formed between the swash plate 18 and the rotor 20 to allow the swash plate 18 to move pivotally relative to the rotor 20.

The swash plate 18 is provided with a bent central hole 18*b* formed through a central part thereof. The drive shaft 15 is extended through the central hole 18*b* to support the swash plate 18 thereon. The inclination of the swash plate 18 is variable without varying the top dead center of each single-headed piston 17 relative to the corresponding bore 16.

In this embodiment, the cylinder block 10, the swash plate 18 and the piston 17 are made of an aluminum alloy, such as a hypereutectic aluminum-silicon alloy. Each piston 17 is provided in its head part with a sliding contact surface 17*a* of a predetermined length fitting the bore 16, in its tail end part with a recess 17*b* (FIG. 4A) extending across the swash plate 18, and on the back side of a part thereof forming the recess 17*b* with a curved interfering surface 17*d* of a large radius of curvature capable of coming into impulsive contact with the inner surface 14*a* defining the crank chamber 14 to prevent the piston 17 from rotation about its own axis.

The surface treatment of the swash plate, which is a feature of the present invention, will be described with reference to FIGS. 5, 6A and 6B.

The swash plate 8 linked to the double-headed pistons 6 in the former embodiment and the swash plate 18 linked to the single-headed pistons 17 in the latter embodiment differ from each other in that the former swash plate 3 has the outer circumference 3*b* with which the interfering surfaces 6*d* of the pistons 6 come into impulsive contact, while the latter swash plate 18 has the outer circumference with which the pistons 17 do not come into direct contact. Therefore, the outer circumference of the swash plate 18 need not be subjected to a surface treatment process for providing the same with a lubricating property. However, the surface treatment of the sliding contact surfaces 3*a* of the swash plate 3 to be in contact with the shoes 7, and the surface treatment of the sliding contact surfaces 18*a* of the swash plate 18 are substantially the same and hence only the surface treatment of the swash plate 3 will be described.

Although not clearly shown in the drawings, the sliding contact surfaces 3*a* formed on a workpiece 3W, i.e., a swash plate 3 that is being manufactured, are selectively processed to finish the sliding contact surfaces 3*a* in a surface roughness of 0.4 $\mu$m Rz or above by a surface roughening process, such as a shot blasting process, for a pretreatment to enhance the strength of adhesion of a film of a solid lubricant to the sliding contact surfaces 3*a*.

Both the sliding contact surfaces 3*a* (and the outer circumference 3*b*, if necessary) of the workpiece 3W are plated with a metal containing tin as a principal component for a selective pretreatment regardless of whether the sliding contact surfaces 3*a* are processed by a surface roughening process. The surface roughness of the sliding contact surfaces 3*a* processed by the surface roughening process is increased to a surface roughness on the order of 12 $\mu$m Rz by plating. Those base surfaces may be finished to a certain surface roughness by a cutting process, and these pretreatment processes may be omitted.

A transfer method (pad transfer method) for forming a film of a solid lubricant on the sliding contact surfaces 3*a* of the workpiece 3W thus pretreated will be described below.

Figure 5:
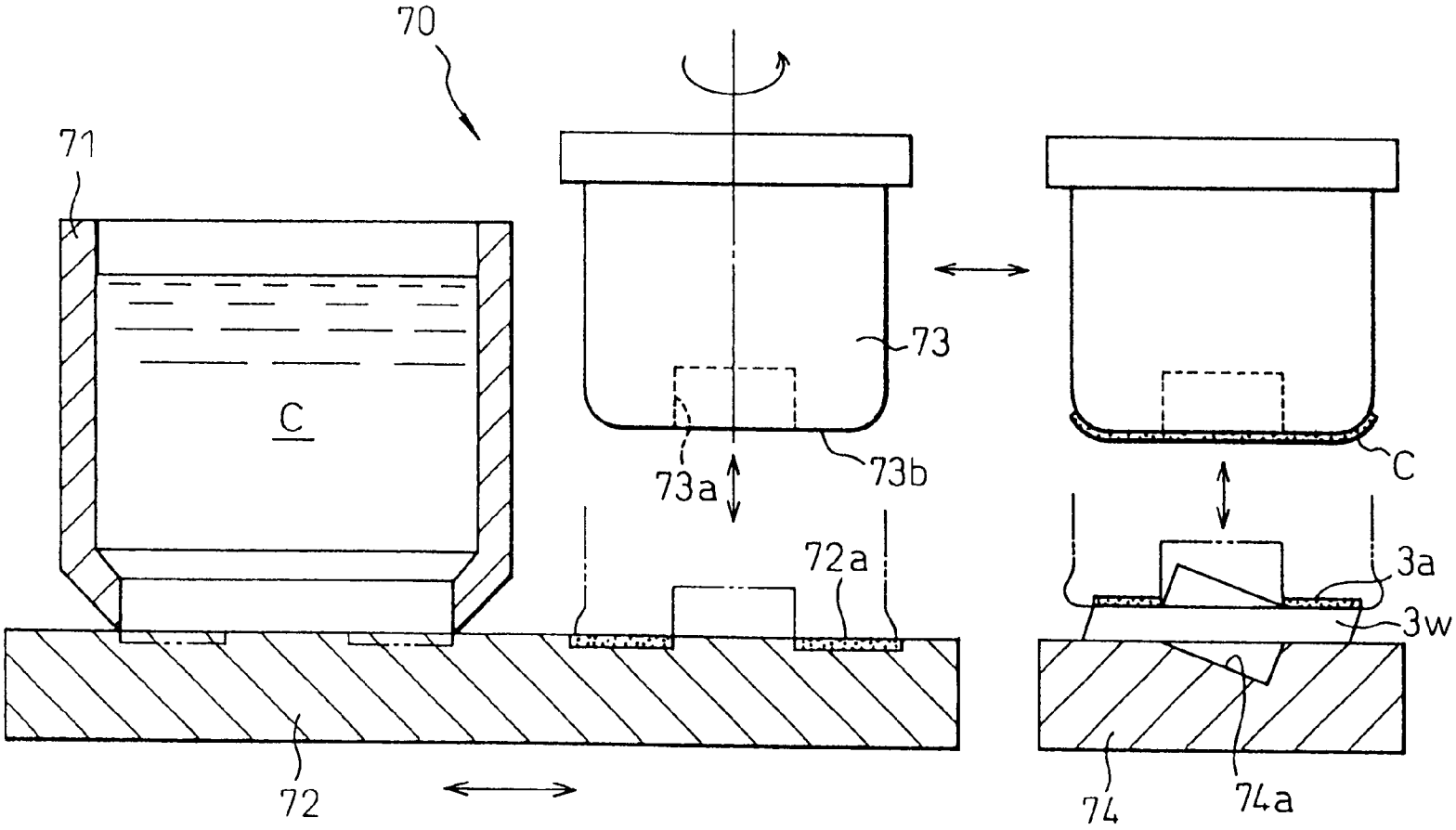
FIG. 5 is a typical view of a transfer apparatus for processing the sliding contact surface of a swash plate.
Figure 6A:
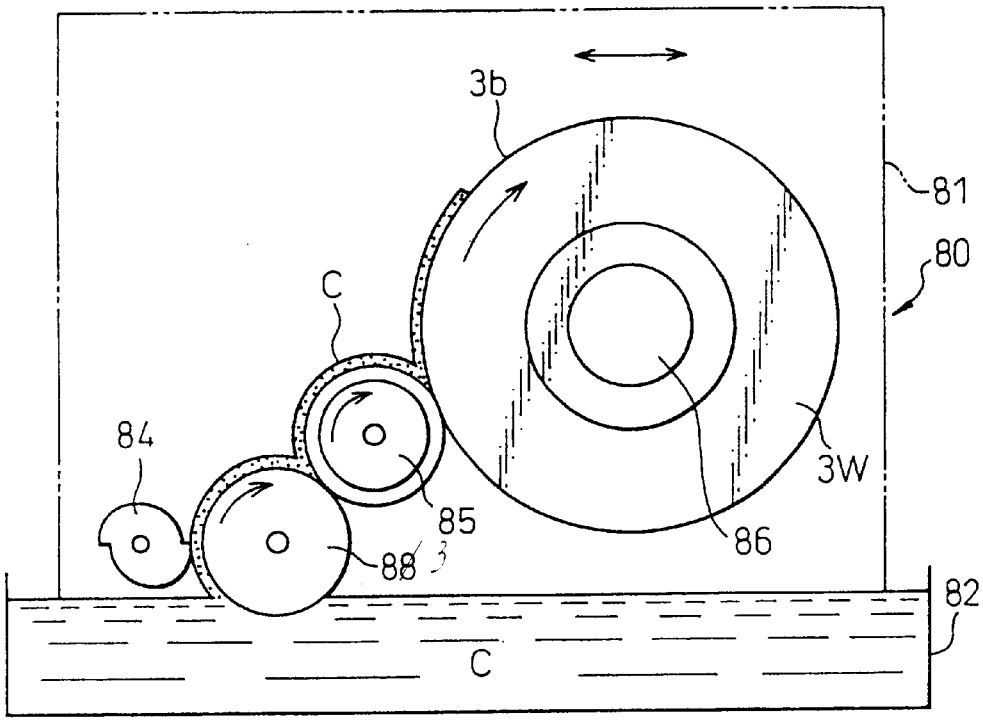
FIG. 6A is a typical view of a transfer apparatus for processing the outer circumference of a swash plate.
Figure 6B:
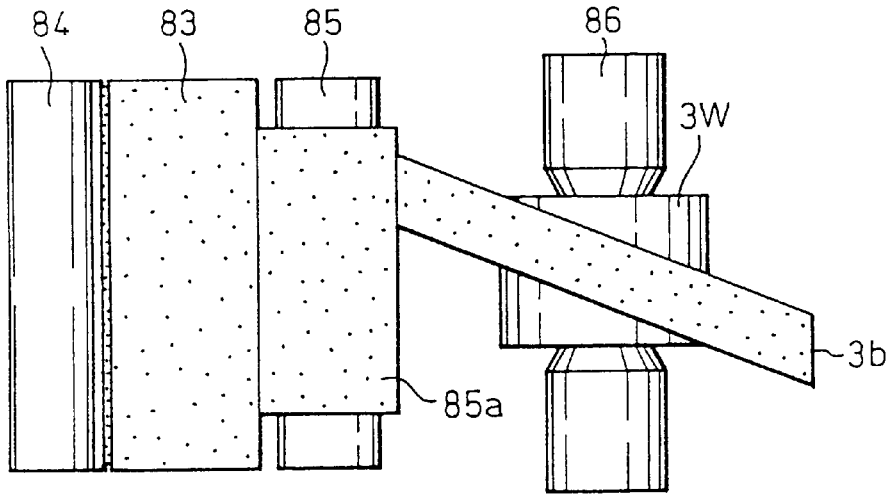
FIG. 6B is a typical development showing the relation between a workpiece for making a swash plate, and rollers.

Referring to FIG. 5, a transfer apparatus 70 has a tank 71. The tank 71 contains a coating material C containing a solid lubricant, such as a mixture of molybdenum disulfide and graphite, and an unsolidified thermosetting resin, such as a polyimide resin. The tank 71 is installed on a slide table 72. The slide table 72 is in sliding contact with the lower open end of the tank 71 and moves horizontally in the directions of the arrows. An annular material holding groove 72*a* of a surface area substantially corresponding to that of the sliding contact surface 3*a* is engraved on the upper surface of the slide table 72. A cylindrical transfer pad 73 of a synthetic rubber is disposed at a waiting position at a predetermined distance in the direction of movement of the slide table 72 from the tank 71. The transfer pad 73 can vertically be moved. The stroke of the slide table 72 is determined so that the material holding grooves 72*a* reciprocate between the waiting position and the center of the tank 71.

The transfer pad 73 is formed so that its lower end surface 73*b* excluding a part in which a relief hole 73*a* for receiving the boss of the workpiece 3W therein bends slightly and fills up the material holding groove 72*a*. The transfer pad 73 can move horizontally between the waiting position and a transfer position, and can move vertically at the waiting position and the transfer position as indicated by the arrows. A support table 74 provided with a positioning recess 74 of a shape corresponding to that of the boss of the workpiece 3W is disposed under the transfer pad 73 as positioned at the transfer position. The support table 74 can be moved between the position shown in FIG. 5 and a drying apparatus, not shown.

The slide table 72 is moved to the left from the waiting position shown in FIG. 5 to locate the material holding groove 72*a* in alignment with the center of the tank 71, i.e., to locate the material holding groove 72*a* so that a circle defining the outer boundary of the material holding groove 72*a* coincides with the edge of the lower open end of the tank 71 as indicated by alternate long and two short dashed lines. Consequently, the material holding groove 72*a* is filled up automatically with the coating material C. Then, the slide table 72 is returned (is moved to the right) to the waiting position and the transfer pad 73 is lowered. Consequently, the lower end surface 73*b* is bent slightly and enters the material holding groove 72*a* and the coating material C adheres to the lower end surface 73*b* of the transfer pad 73.

The transfer pad 73 thus wetted with the coating material C is raised, is moved to the right to the transfer position corresponding to the support table 74, is lowered to press the lower end surface 73*b* against the sliding contact surface 3*a* of the workpiece 3W to transfer the coating material C from the lower end surface 73*b* to the sliding contact surface 3*a*, i.e., to coat the sliding contact surface 3*a* with the coating material C.

If necessary, the workpiece 3W having the sliding contact surface 3*a* thus coated with the coating material C is put in a drying apparatus for drying together with the support table 74, and the foregoing steps are repeated to adjust the thickness of the film. Similarly, the sliding contact surface 3*a* formed on the other side of the workpiece 3W is coated with the coating material C, and the films formed on the sliding contact surfaces 3*a* are made to adhere firmly to the sliding contact surfaces 3*a* by a baking process.

A transfer method (roller transfer method) for forming a film of a solid lubricant on the outer circumference 3*b* of the workpiece 3W will be described below with reference to FIGS. 6A and 6B.

A transfer apparatus 80 has a tank 82 containing a coating material C containing a solid lubricant, such as a mixture of molybdenum disulfide and graphite, and an unsolidified thermosetting resin, such as a polyamidimide resin, a metal roller 83 partly dipped in the coating material C contained in the tank 82, a comma roller 84 disposed near the metal roller 83 with a predetermined gap therebetween, a transfer roller 85 of a synthetic rubber having a coating part 85*a* of an increased diameter conforming to the locus of rotation of the outer circumference 3*b* of the workpiece 3W, and disposed with the coating part 85*a* in contact with the metal roller 83, a work holder 86 for rotatably holding the workpiece 3W, and a driving mechanism 81 for driving the rollers 83 and 85 for rotation in the directions of the arrows.

When the rollers 83 and 85 are rotated by the driving mechanism 81, the coating material C adheres to the circumference of the metal roller 83, the thickness of a layer of the coating material C on the metal roller 83 is adjusted by the comma roller 84, and the layer of the coating material C is transferred from the metal roller 83 to the coating part 85*a* of the transfer roller 85. When the rotating workpiece 3W is brought into contact with the transfer roller 85 by the work holder 86, the coating material C is applied (transferred) to the outer circumference 3*b* of the workpiece 3W from the transfer roller 85. Then the workpiece 3W is separated from the transfer roller 85 and is removed from the work holder 86. The workpiece 3W is subjected to a drying process to remove a solvent from the coating material C and is subjected to a baking process to form a film firmly adhering to the outer circumference 3*b*.

The representative processes of forming the films of the solid lubricant on the workpiece 3W illustrated in FIGS. 5, 6A and 6B may be carried out in the following manner.

The sliding contact surfaces 3*a* and the outer circumference of 3*b* of the workpiece 3W may be roughened by shot blasting to a desirable surface roughness in the range of 2 to 12 $\mu$m Rz, and films of the solid lubricant may directly be formed on the sliding contact surfaces 3*a* and the outer circumference 3*b* without plating the sliding contact surfaces 3*a* and the outer circumference 3*b* of the workpiece 3W. It is obvious that the films of the solid lubricant can be formed by the transfer apparatus 70 shown in FIG. 5 or the transfer apparatus 80 shown in FIGS. 6A and 6B.

In another embodiment, sprayed layers of a copper-bearing metal may be formed by spraying on the sliding contact surfaces 3*a* and the outer circumference 3*b* of the workpiece 3W, and films of the solid lubricant may be formed on the sprayed layers. The surfaces of the sprayed layers may be roughened by shot blasting to a surface roughness in the range of 2 to 12 $\mu$m Rz, and then the films of the solid lubricant may be formed on the roughened sprayed layers.

It should be understood that shot peening, sand blasting or cutting by a tool may be used instead of shot blasting for surface roughening.

Naturally, the foregoing embodiments relating to the workpiece 3W are applicable also to the manufacture of the swash plate 18.

Figure 7A:
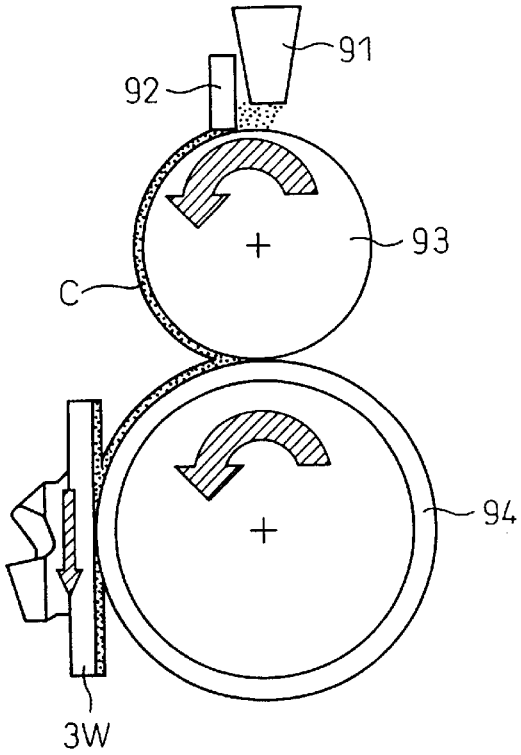
FIGS. 7A and 7B are showing a roller coating method of applying a lubricating film to a sliding contact surface (flat surface) of a swash plate.
Figure 7B:
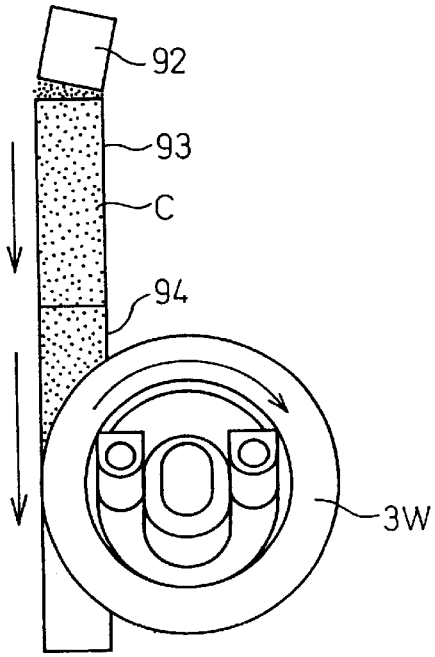

A transfer method (roller transfer method) for forming a film of a solid lubricant on the flat surface of the workpiece (swash plate) 3W will be described below with reference to FIGS. 7A and 7B. When a metal roller 93 and a rubber roller 94 are rotated by a driving mechanism, a coating material C is supplied from a dispenser 91. The coating material is applied to the metal roller 93. The thickness of a layer of the coating material C supplied on the metal roller 93 is adjusted to the thickness to be required by a blade 92. The layer of the coating material C on the metal roller 93 is transferred from the metal roller 93 to the rubber roller 94. The metal roller 93 and the rubber roller 94 rotate in the same direction. When a rotating workpiece (a swash plate) 3W is brought into contact with the roller 94, and the rotation of the swash plate synchronizes to that of the rubber roller 94, the coating material is applied to a flat sliding contact surface 3*a* of the swash plate (workpiece) from the rubber roller 94. The rotating direction of the swash plate (workpiece) is at a right angle to that of the rubber roller 94, as shown in FIG. 7A.

In this case, since the speed of the coating surface is different between the inner circumference side and the outer circumference side of the coating surface (the speed of the outer circumference side is faster than that of the inner circumference side), the thickness of the layer on the outer circumference side of the coating surface tends to become thinner. Therefore, the blade 92 is slightly inclined and the thickness of the layer corresponding to the outer circumference side of the coating surface is made thicker when the coating material is supplied from the dispenser 91 to the metal roller 93. Thus, the coating material is coated uniformly on the coating surface (flat surface 3*a*) of the swash plate (workpiece).

As is apparent from the foregoing description, according to the present invention, the swash plate included in the swash plate type compressor has sliding contact surfaces coated with the film of the solid lubricant, the film of the solid lubricant, provides an excellent lubricating performance, and the coating of the sliding contact surfaces with the film of the solid lubricant by the transfer method is very advantageous from the viewpoint of economy and productivity in the yield of the coating material and the control of the thickness of the film.

If the sliding contact surfaces of the swash plate on which the film is formed, i.e., the base surfaces for the film, are finished by a surface roughening process, the coating material is forced to dig into the irregularities formed to provide an anchoring effect which enhances the strength of adhesion of the film to the sliding contact surfaces. If the sliding contact surfaces and the outer circumference of the swash plate are coated for surface preparation with plated films of a material containing tin as a principal component, a further satisfactory durability will be guaranteed.

LIST OF REFERENCE CHARACTERS

| | |
|---|---|
| 1A | Cylinder block |
| 1B | Cylinder block |
| 2 | Drive shaft |
| 3 | Swash plate |
| 3a | Sliding contact surface |
| 3b | Outer circumference |
| 4 | Swash plate chamber |
| 5 | Cylinder bore |
| 6 | Double-headed piston |
| 6a | Sliding contact surface |
| 6b | Recess |
| 6d | Interfering surface |
| 7 | Shoe |
| 10 | Cylinder block |
| 11 | Front housing |
| 12 | Valve plate |
| 13 | Rear housing |
| 14 | Crank chamber |
| 15 | Drive shaft |
| 16 | Cylinder bore |
| 17 | Single-headed piston |
| 18 | Swash plate |
| 19 | Shoe |

What is claimed is:

1. A method of applying a lubricating film to a piston assembly bearing surface of a swash plate type compressor, comprising:

providing a swash plate having at least one sliding contact surface, which is formed on a flat surface of the swash plate, for engaging a piston assembly in sliding contact therewith;

supplying a solid lubricating material from a source of supply to a roller;

rotating the swash plate about an axis that is different from the axis of rotation of the roller so that the sliding contact surface of the swash plate moves in a direction different from the direction of the movement of the roller surface and in close proximity thereto; and applying a solid lubricating material film to the roller surface whereby a film of the lubricating material transfers from the roller to the sliding contact surface of the swash plate.

2. The method of claim 1, wherein the thickness of a layer of said solid lubricating material is adjusted by a blade to the thickness required to coat said flat surface of the swash plate when said lubricating material is supplied to said roller.

3. The method of claim 1, wherein the axis of rotation of said swash plate is generally perpendicular to that of said roller.

4. The method of claim 2, wherein said blade is inclined relative to the roller surface so that the amount of said lubricating material supplied to the outer circumference side of the flat surface of said swash plate is greater than the amount of lubricating material supplied to the inner circumference side thereof.

* * * * *

UNITED STATES PATENT AND TRADEMARK OFFICE

CERTIFICATE OF CORRECTION

PATENT NO. : 6,694,864 B2
DATED : February 24, 2004
INVENTOR(S) : Takayuki Kato et al.

It is certified that error appears in the above-identified patent and that said Letters Patent is hereby corrected as shown below:

Title page,
Insert Item -- [30] Foreign Application Priority Data
10/09/1997 (JP) 9-277657
04/16/1998 (JP) 10-106703 --

Signed and Sealed this

Eighteenth Day of May, 2004

JON W. DUDAS
*Acting Director of the United States Patent and Trademark Office*